US009051069B2

(12) United States Patent
Meersoek

(10) Patent No.: US 9,051,069 B2
(45) Date of Patent: Jun. 9, 2015

(54) SYSTEMS AND METHODS FOR STRAPPING A SET OF DOCUMENTS

(75) Inventor: Martinus Johannes Pieter Meersoek, Huizen (NL)

(73) Assignee: De La Rue North America Inc., Irving, TX (US)

( * ) Notice: Subject to any disclaimer, the term of this patent is extended or adjusted under 35 U.S.C. 154(b) by 471 days.

(21) Appl. No.: 13/592,335

(22) Filed: Aug. 22, 2012

(65) Prior Publication Data

US 2014/0053505 A1 Feb. 27, 2014

(51) Int. Cl.
*B65B 13/02* (2006.01)
*B65B 13/14* (2006.01)

(52) U.S. Cl.
CPC ..... *B65B 13/02* (2013.01); *B65B 13/14* (2013.01)

(58) Field of Classification Search
CPC ..... B65B 13/02; B65B 13/14; B65B 25/14; B65B 49/06; B65B 49/08
USPC ..... 100/5, 8, 17, 29, 32, 33 PB; 53/209, 53/213, 215, 218, 229, 443, 447, 462, 466, 53/540, 543, 582, 586, 590, 591
See application file for complete search history.

(56) References Cited

U.S. PATENT DOCUMENTS

| | | | | |
|---|---|---|---|---|
| 3,991,542 | A | 11/1976 | White et al. | |
| 4,271,655 | A | 6/1981 | Nagayoshi | |
| 4,276,736 | A * | 7/1981 | Haberstroh et al. | 53/399 |
| 4,412,484 | A | 11/1983 | Beethem et al. | |
| 4,466,227 | A | 8/1984 | Hanscom | |
| 4,573,305 | A * | 3/1986 | Wildmoser | 53/466 |
| 4,657,465 | A | 4/1987 | Aoki | |
| 4,930,293 | A * | 6/1990 | Hanscom | 53/590 |
| 4,956,961 | A | 9/1990 | Janhonen | |
| 5,410,862 | A | 5/1995 | Janhonen | |
| 5,487,256 | A | 1/1996 | Janhonen | |
| 5,996,314 | A | 12/1999 | Pennini et al. | |
| 6,135,703 | A | 10/2000 | Neri | |
| 6,185,905 | B1 | 2/2001 | Neri | |
| 6,318,053 | B1 | 11/2001 | Frank et al. | |
| 6,336,308 | B1 | 1/2002 | Kokkersvold et al. | |

(Continued)

FOREIGN PATENT DOCUMENTS

| | | | |
|---|---|---|---|
| IE | 2123145 | A1 | 11/2009 |
| JP | 7040928 | A | 2/1995 |
| WO | WO 02/38484 | A1 | 5/2002 |

OTHER PUBLICATIONS

International Search Report and Written Opinion date mailed Nov. 12, 2013; PCT International Application No. PCT/US13/41589.

*Primary Examiner* — Jimmy T Nguyen
(74) *Attorney, Agent, or Firm* — R. Johnston Law, PLLC

(57) ABSTRACT

An apparatus for strapping a set of documents includes a document platform to receive a set of documents and a document strap while the document platform is in a receiving position. The document strap is positionable between the document platform and the set of documents. A frame having a first frame arm and a second frame arm forming a platform-receiving space between the first and second frame arms, and a belt disposed between the document platform and the document strap when the document platform receives the set of documents. The document platform is movable from the receiving position into the platform-receiving space to cause the belt and the document strap to at least partially surround the set of documents, thereby strapping the set of documents together.

20 Claims, 13 Drawing Sheets

(56) References Cited

U.S. PATENT DOCUMENTS

| | | | | |
|---|---|---|---|---|
| 6,536,336 | B1 | 3/2003 | Jaenson et al. | |
| 6,826,891 | B2 | 12/2004 | Sauer | |
| 7,143,689 | B2 | 12/2006 | Dopfer et al. | |
| 7,325,376 | B1 | 2/2008 | DiNello et al. | |
| 7,367,169 | B2 | 5/2008 | Katsumata | |
| 7,421,944 | B1 | 9/2008 | Flaum et al. | |
| 7,536,844 | B2 | 5/2009 | Aubin et al. | |
| 7,600,626 | B2 | 10/2009 | Hallowell et al. | |
| 7,752,960 | B2 * | 7/2010 | Toor et al. | 100/88 |
| 7,770,359 | B2 | 8/2010 | Sauer et al. | |
| 7,779,982 | B2 | 8/2010 | Fitzgerald et al. | |
| 7,992,857 | B2 | 8/2011 | Igata | |

* cited by examiner

SYSTEMS AND METHODS FOR STRAPPING A SET OF DOCUMENTS

TECHNICAL FIELD

The illustrative embodiments relate generally to strapping documents, and more particularly, to systems and methods for strapping a set of documents using a document strap.

BACKGROUND

When handling or processing multiple documents, such as banknotes (e.g., currency or paper money), checks, legal-related documents, and other document types, it is sometimes convenient or desirable to bundle the documents into batches. For example, document straps may be used to bundle banknotes having the same denomination or other attributes into bundles having a predetermined number of banknotes. Such bundling of documents may occur in many different applications, including the sorting, authentication, counting, creation, or other processing of currency. Current systems may fail to properly, snugly, or efficiently wrap document straps around stacks of documents. For example, when applying a document strap to a stack of documents, current systems may apply a document strap too loosely, causing the stack of documents to be improperly secured or vulnerable to documents falling out of the bundle. Indeed, current strapping systems or methods may suffer from other issues or drawbacks as well.

SUMMARY

According to an illustrative embodiment, an apparatus for strapping a set of documents includes a document platform to receive a set of documents and a document strap while the document platform is in a receiving position. The document strap is positionable between the document platform and the set of documents. The apparatus also includes a frame having a first frame arm and a second frame arm forming a platform-receiving space between the first and second frame arms, and a belt disposed between the document platform and the document strap when the document platform receives the set of documents. The document platform is movable from the receiving position into the platform-receiving space to cause the belt and the document strap to at least partially surround the set of documents, thereby strapping the set of documents together.

According to another illustrative embodiment, an apparatus for strapping a set of documents includes a document platform to receive a document strap and a set of documents on top of the document strap, and a frame having a first frame arm and a second frame arm forming a platform-receiving space between the first and second frame arms. Each of the first and second frame arms have an upper portion hingeably rotatable into the platform-receiving space. The apparatus also includes a belt positioned around outer-facing sides of the frame. A portion of the belt is disposed between the document platform and the document strap when the document platform receives the set of documents. The document platform is movable between a raised, receiving position and a lowered position. The document platform is lowered in the platform-receiving space when in the lowered position. When the document platform moves from the raised position to the lowered position, the upper portions of the first and second frame arms move toward one another to cause the belt and the document strap to at least partially surround the set of documents, thereby strapping the set of documents together.

According to another illustrative embodiment, an apparatus for strapping a set of documents includes a document platform and a belt disposed adjacent the document platform. The belt is movable to draw a document strap onto the document platform. A set of documents is adapted to be placed on the document platform such that the document strap is between the set of documents and the document platform. The belt is foldable at least partially around the set of documents to cause the document strap to at least partially surround the set of documents, thereby strapping the set of documents together.

According to another illustrative embodiment, a method for strapping a set of documents includes receiving a document strap on a belt. The belt is positioned on a document platform. The method also includes receiving a set of documents on the document platform, the document strap, and the belt. The method also includes the belt moving to at least partially wrap around the set of documents to cause the document strap to at least partially wrap around the set of documents such that a first end of the document strap is adjacent a second end of the document strap in response to lowering the document platform between a first frame arm and a second frame arm. The method also includes sealing the first end of the document strap to the second end of the document strap to secure the document strap around the set of documents.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

Figure 1:
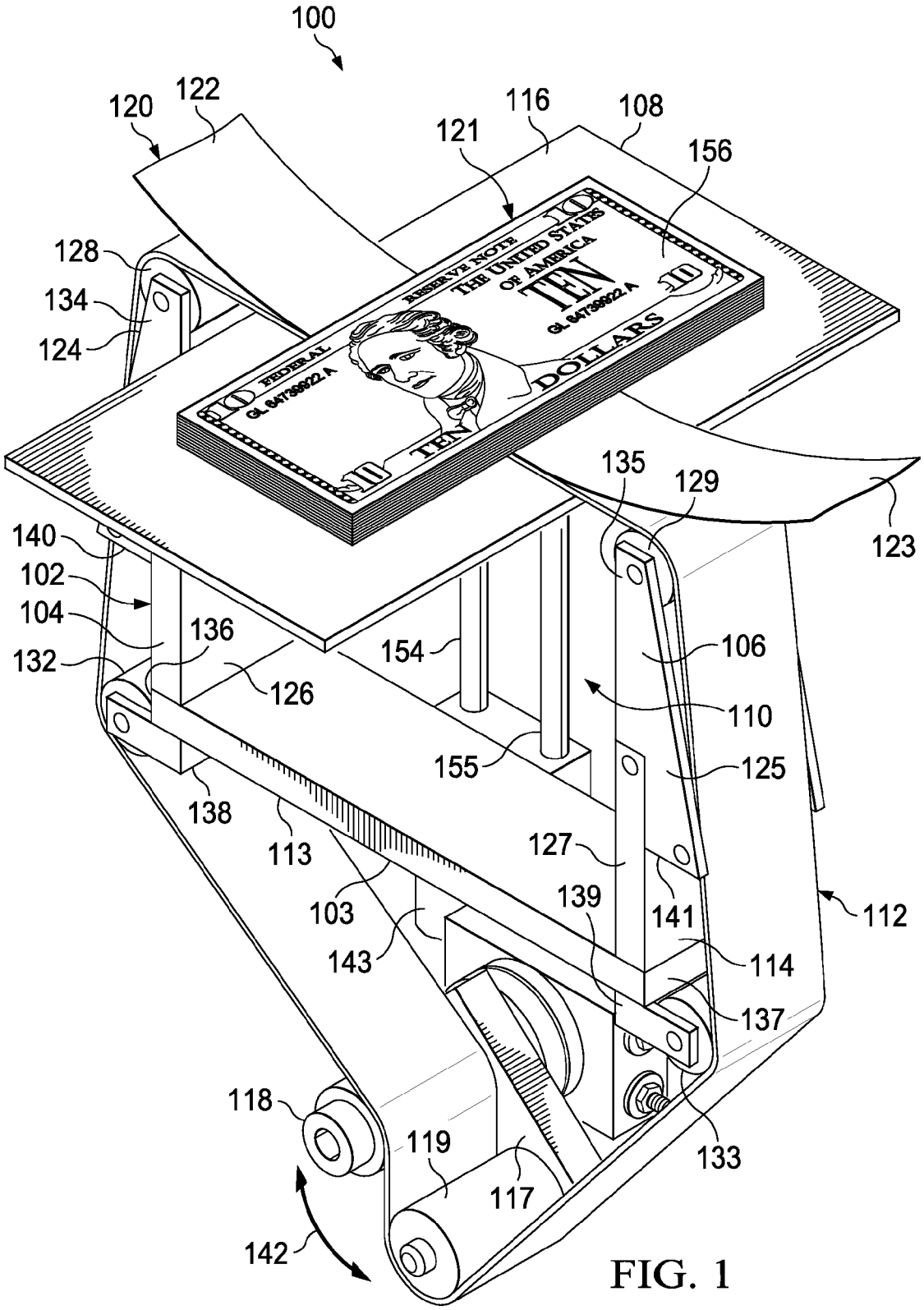
FIG. 1 is a schematic, perspective view of a document strapping system according to an illustrative embodiment.

Referring to FIGS. 1 through 4, an illustrative embodiment of a document strapping system 100 includes a frame 102, which has a first frame arm 104 and a second frame arm 106. The document strapping system 100 also includes a document platform 108, which may move from a receiving, or heightened, position, as shown in FIGS. 1 and 2A, to a lowered position within the platform-receiving space 110 formed between the first and second frame arms 104, 106; the document platform 108 is shown in the lowered position in FIG. 2D. Unless otherwise indicated, as used herein, "or" does not require mutual exclusivity. The document platform 108 may also be positioned at any intermediate positions between the receiving position and the lowered position, one example of which is shown in FIG. 2B. The first frame arm 104 and the second frame arm 106 may each be substantially perpendicular to the frame base 103 when the document platform 108 is in the receiving position, as shown in FIGS. 1 and 2A.

The document strapping system 100 also includes a belt 112 disposed around the frame 102. In particular, the belt 112 is positioned adjacent outer-facing sides 113, 114, and 115 of the frame base 103, the first frame arm 104, and the second frame arm 106, respectively. The belt 112 also passes over, or on top of, a top side 116 of the document platform 108. The belt 112 may also pass through rollers 118, 119 on a tensioner 117, which may be used to increase or decrease tension of the belt 112 and will be described in further detail below.

Figure 2A:
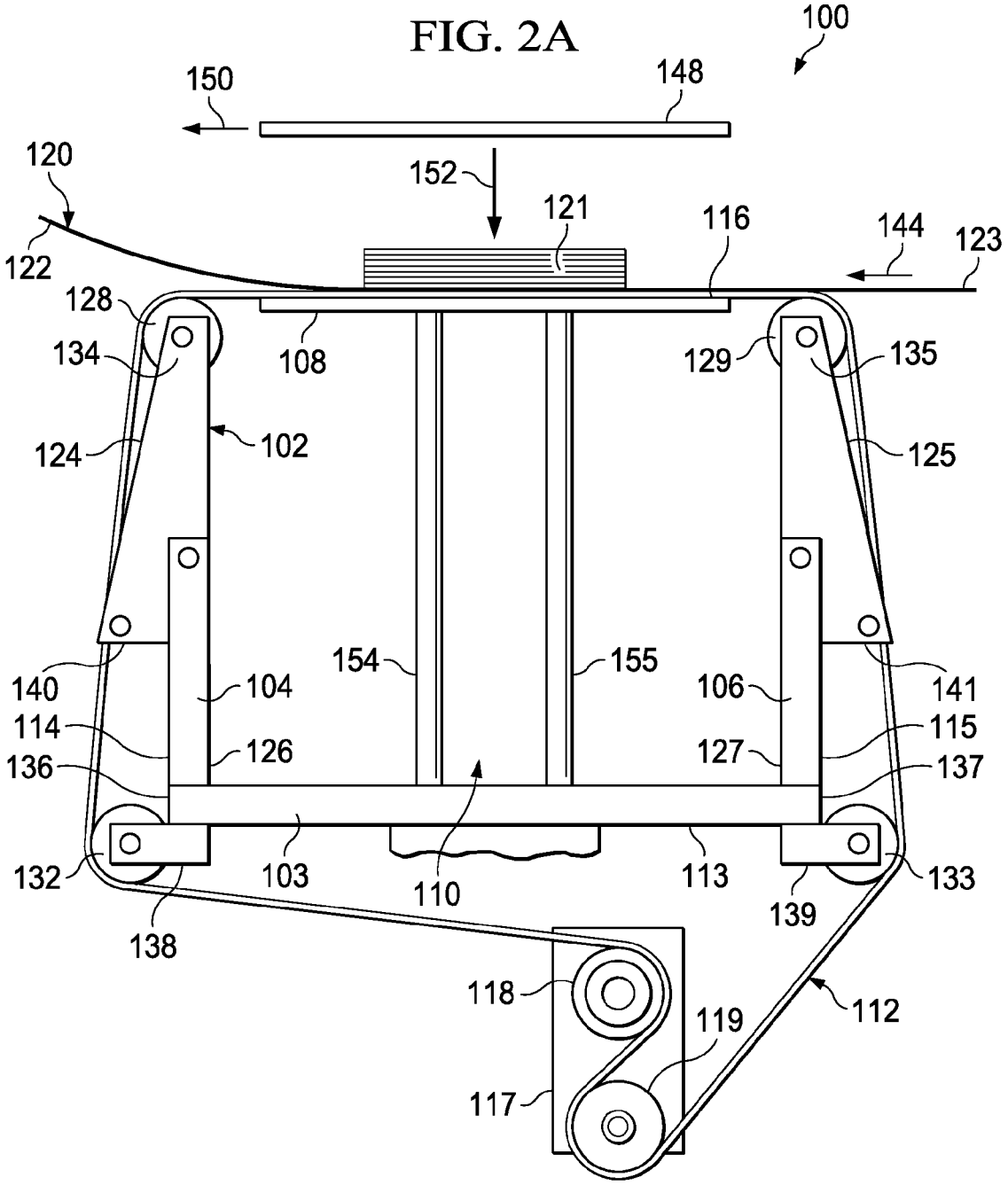
FIG. 2A is a schematic, side view of a document strapping system having a document platform in the receiving position according to an illustrative embodiment.

A document strap 120 may be placed on the document platform 108, and a set of documents 121 may be placed on the strap 120 and the document platform 108, as shown in FIGS. 1 and 2A. As used herein, including in the claims, the term "set" encompasses a quantity of one or more. A set of documents may refer to a plurality of individual sheets that may be strapped together—commonly referred to as a stack. A set of documents may also refer to a plurality of strapped stacks to be strapped together—commonly referred to as a bundle.

Figure 4:
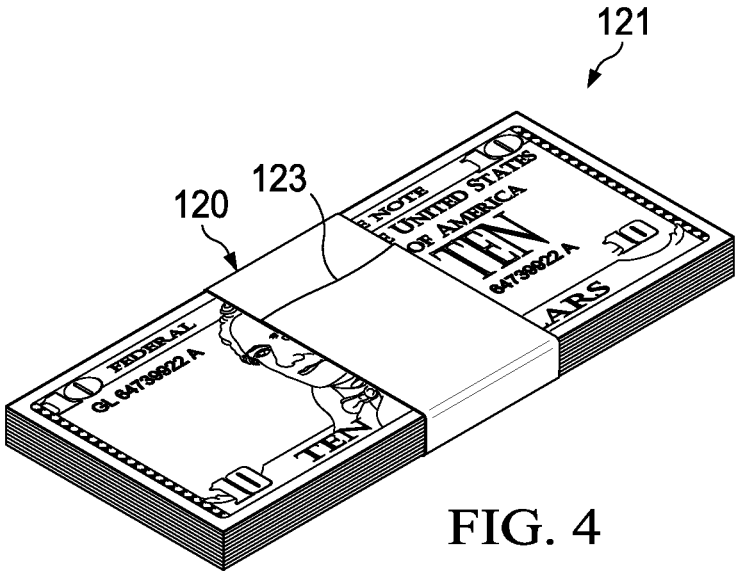
FIG. 4 is a schematic, perspective view of a set of documents that has been strapped with a document strap using the document strapping system according to an illustrative embodiment.

As shown in FIGS. 1 and 2A, the strap 120 is disposed between the set of documents 121 and the top side 116 of the document platform 108, and a portion of the belt 112 is disposed between the strap 120 and the top side 116 of the document platform 108. In one embodiment, while in this configuration, the document platform 108 may be lowered into the platform receiving space 110 to cause the belt 112 and the document strap 120 to at least partially surround the documents 121. The tensioner 117 may then be used to tighten the belt 112, causing the strap 120 to more snugly fit the documents 121. A first end 122 of the document strap 120 may then be adhered to a second end 123 of the document strap 120 to securely strap the documents 121 together. FIG. 4 shows an example of the set of documents 121 bundled together by the strap 120 by the document strapping system 100 using this example process.

While the document strapping system 100 may be used to strap or bundle any type of document, the documents 121 shown in FIGS. 1-4 are banknotes. Indeed, the documents 121 may be banknotes from any country of origin. Other types of documents 121 on which the document strapping system 100 may be used include financial documents (e.g., checks, money orders, travelers checks, etc.), legal-related documents, passports, or any other type of document capable of being bundled or strapped.

As used herein, including in the claims, the positional terms "on" or "onto" include directly, indirectly, or partially on, and do not necessarily require physical contact. For example, the document strap 120 may be considered to be "on" the document platform 108 when the belt 112 is between the document strap 120 and the document platform 108.

In one embodiment, the first and second frame arms 104 and 106 may each include upper, movable portions 124 and 125, respectively. In particular, the first frame arm 104 may include the upper portion 124 hingeably coupled to a lower post 126. In a non-limiting example, the upper portion 124 may be coupled to the lower post 126 using a pin to allow for a hingeable connection. The upper portion 125 of the second frame arm 106 may be hingeably coupled to the lower post 127; a pin may also be used to hingeably couple the upper portion 125 to the lower post 127.

By allowing the upper portions 124 and 125 to hingebly couple to the lower posts 126 and 127, respectively, as the document platform 108 descends into the document platform-receiving space 110, as shown progressively in FIGS. 2A through 2D, the upper portions 124 and 125 move toward one another and into the platform-receiving space 110 to facilitate wrapping of the belt 112 and the strap 120 around the documents 121. When the document platform 108 is in the document receiving position, as shown in FIGS. 1 and 2A, the upper portions 124, 125 are in a substantially upright position, as also shown in FIGS. 1 and 2A; when in the substantially upright position, the upper portion 124 of the first frame arm 104 is substantially parallel to the lower post 126 of the first frame arm 124. Likewise, when the upper portion 125 is in the substantially upright position, the upper portion 125 is substantially parallel to the lower post 127 of the second frame arm 106.

Figure 2B:
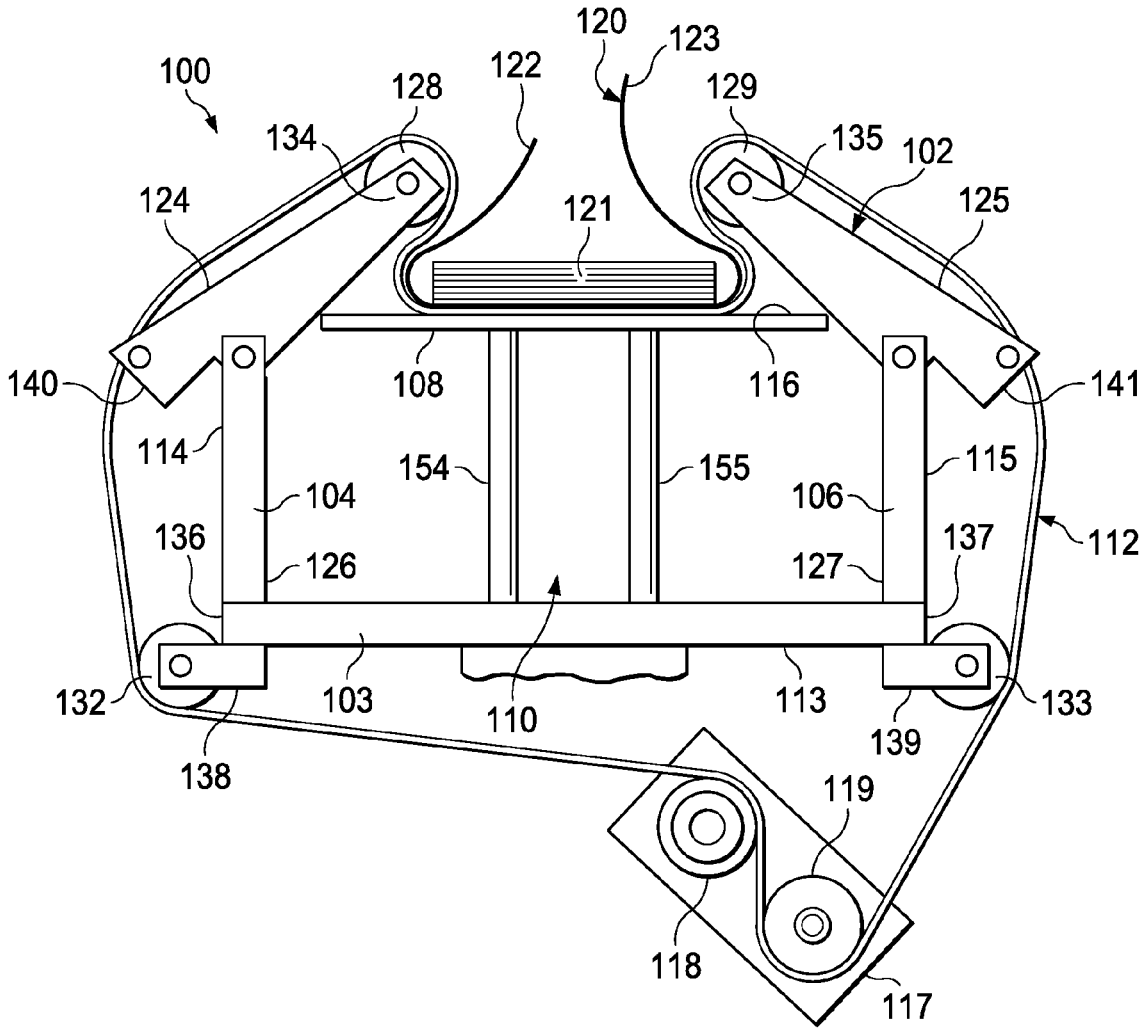
FIG. 2B is a schematic, side view of the document strapping system in FIG. 2A with the document platform descending between the first and second frame arms according to an illustrative embodiment.
Figure 2C:
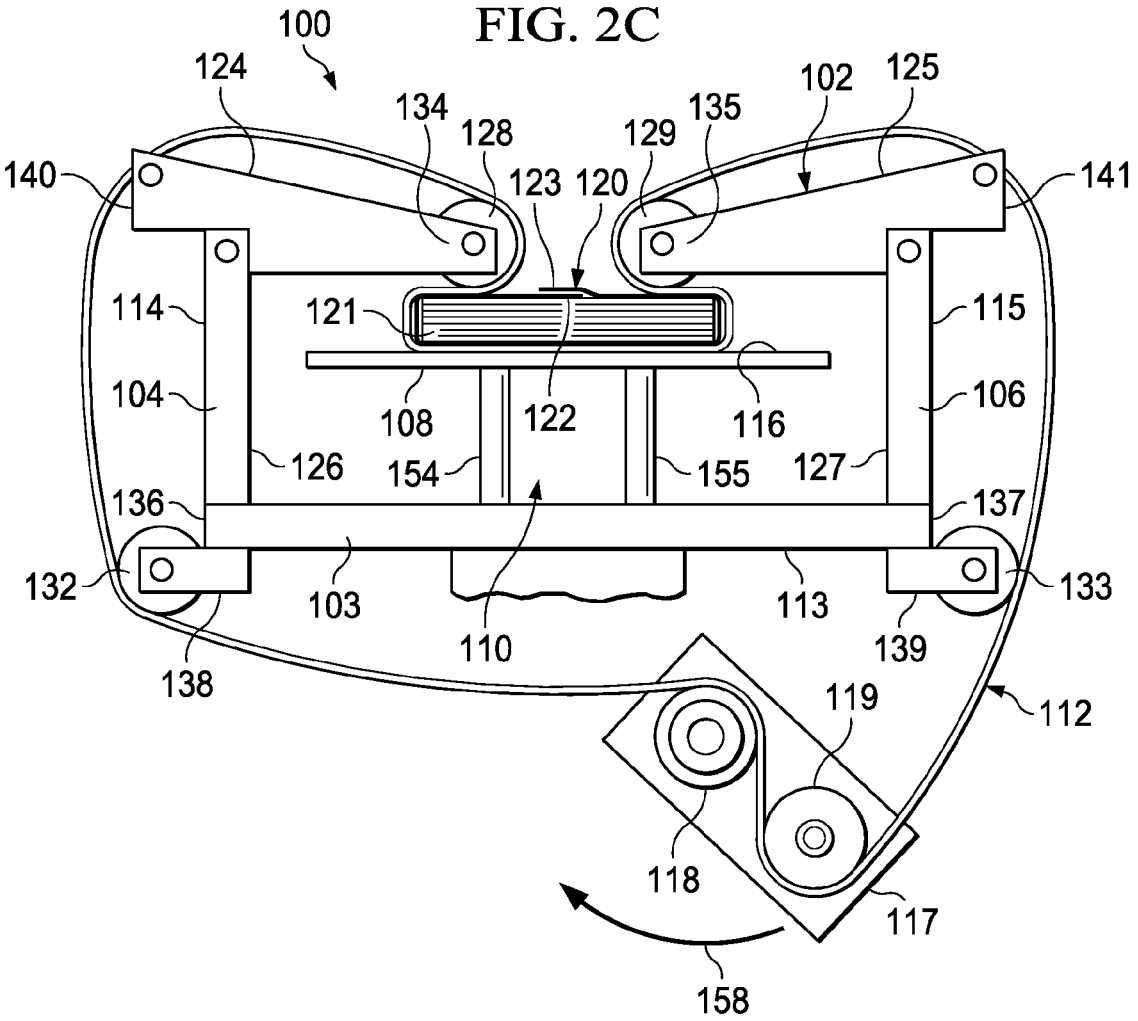
FIG. 2C is a schematic, side view of the document strapping system in FIG. 2B showing the document platform in the lowered position according to an illustrative embodiment.

When the document platform 108 has moved into the lowered position in the platform-receiving space 110, as shown in FIG. 2C, the upper portions 124, 125 of the first and second frame arms 104, 106 are in an inward-pointing position, as also shown in FIG. 2C. When the upper portion 124 of the first frame arm 104 is in the inward-pointing position, the upper portion 124 is substantially perpendicular to the lower post 126 of the first frame arm 104. Likewise, when the upper portion 125 of the second frame arm 106 is in the inward-pointing position, the upper portion 125 is substantially perpendicular to the lower post 127 of the second frame arm 106. The upper portions 124, 125 of the first and second frame arms 104, 106 may also be in any intermediate position between the substantially upright position and the inward-pointing position as the document platform 108 moves from the document receiving position to the lowered position, an example of which is illustrated by FIG. 2B.

As used herein, the term "coupled" may include coupling via a separate object and may also include direct coupling. The term "coupled" may also encompass two or more components that are continuous with one another by virtue of each of the components being formed from the same piece of material. Also, the term "coupled" may include chemical, such as via a chemical bond, mechanical, thermal, magnetic, or electrical coupling.

In one embodiment, the document strapping system 100 may include a set of rollers 128, 129, 132, 133 coupled to the frame 102 and adapted to contact the belt 112 to facilitate movement of the belt 112 around the frame 102. While any number of rollers may be used, in any spatial configuration, to facilitate movement of the belt 112, in one embodiment, a first top roller 128 may be coupled adjacent a top end 134 of the first frame arm 104, and a second top roller 129 may be coupled adjacent a top end 135 of the second frame arm 106. The set of rollers may also include a first bottom roller 132 coupled adjacent a first end 136 of the frame base 103, and a second bottom roller 133 coupled adjacent a second end 137 of the frame base 103. In one non-limiting example, the first and second bottom rollers 132, 133 may be coupled to the frame base 103 by respective brackets 138, 139.

In another embodiment, the set of rollers may also include a first middle roller coupled adjacent the first frame arm 104 between the first top roller 128 and the first bottom roller 132. The set of rollers may also include a second middle roller coupled adjacent the second frame arm 106 between the second top roller 129 and the second bottom roller 133. In one example, the first middle roller may be adjacent the hingeable coupling between the upper portion 124 and the lower post 126 of the first frame arm 104. The first middle roller may also be coupled adjacent a bottom end 140 of the upper portion 124 of the first frame arm 104. The second middle roller may be coupled adjacent the hingeable coupling between the upper portion 125 and the lower post 127 of the second frame arm 106. The second middle roller may also be coupled adjacent the bottom end 141 of the upper portion 125 of the second frame arm 106.

In one embodiment, the document strapping system 100 also includes the tensioner 117, which may be located adjacent the frame 102, the frame base 103, or anywhere else in the document strapping system 100 that allows for the tensioner 117 to vary the tension of the belt 112. The tensioner 117 may be used to increase or decrease the tension of the belt 112 around the frame 102. As will be described in further detail below, controlling the tension of the belt 112 may be used to facilitate wrapping of the strap 120 around the set of documents 121 in a secure and snug manner.

The tensioner 117 may include a central roller 118 and a peripheral roller 119. The belt 112 may weave, or be passed through, the central and peripheral rollers 118, 119 as shown in FIGS. 1 and 2A through 2D. By passing the belt 112 through the central and peripheral rollers 118, 119 in this manner, rotation of the peripheral roller 119 around the central roller 118 may be controlled to increase or decrease the tension of the belt 112 around the frame 102. The direction of motion of the peripheral roller 119 around the central roller 118 is illustrated by the arrow 142. In one example, the peripheral roller 119 may have a range of motion that is 360° around the central roller 118, although any subset of this range of motion may be utilized. The tensioner 117 may be coupled within the document strapping system 100 in a variety of ways, including by coupling to a primary post 143, an outer-facing side 113 of the frame base 103, or any other device or component whether part of the document strapping system 100 or not.

In one embodiment, the central roller 118 may be operatively coupled to a motor (not shown) that may be used to rotate the central roller 118. In one example, rotation of the central roller 118 may be used to motivate the belt 112 around the frame 102. While movement of the belt 112 around the frame 102 may be used for a variety of purposes, in one embodiment, the central roller 118 may motivate the belt 112 around the frame 102 to draw the document strap 120 onto the document platform 108 while the document platform 108 is in the receiving position, as shown in FIGS. 1 and 2A. Thus, the document strap 120 may be fed into the document strapping system 100 and moved into the position shown in FIGS. 1 and 2A (e.g., on the top side 116 of the document platform 108) in the direction indicated by the arrow 144, or opposite thereof, by rotating the central roller 118 in either direction so that the belt 112 may draw the document strap 120 onto the document platform 108.

The tensioner 117, and more specifically the rotation of the peripheral roller 119 around the central roller 118, may be controlled pneumatically by adjusting a fluid, including gas, pressure. The torque produced by the tensioner 117 may also be controlled pneumatically by adjusting a fluid pressure. The tensioner 117 may include one or more inputs/outputs 146, 147 that may be used to control the range of motion, or rotation, of the tensioner 117 using pneumatic power. Any type of fluid may be used, including, but not limited to, air, water, etc. As will be described below, by controlling rotation of the peripheral roller 119 around the central roller 118 using fluid pressure, tension of the belt 112 may also be controlled using such fluid pressure. Other or alternative means for controlling the rotation of the tensioner 117 may include hydraulic force, electromechanical force, an electrical-gear drive, springs, magnets, etc.

It will be appreciated that the distance between the central roller 118 and the peripheral roller 119 may vary depending on the desired control of tension of the belt 112. For example, a greater distance between the rollers 118, 119 may allow for greater variability in tension of the belt 112, or may accommodate different sized belts or frames.

Referring specifically to FIG. 2A, the document strapping system 100 may also include a document collection plate 148, or slicer or sliding plate, which may be positionable above the document platform 108. In one embodiment, the document collection plate 148 may collect the set of documents 121 until a predetermined or desired number or thickness of documents has been collected. The document collection plate 148 may then be moved or retractable to drop the set of documents 121 onto the document platform 108 while the document platform 108 is in the receiving position, as shown in FIG. 2A. An example of the direction in which the document collection plate 148 may be retracted is indicated by the arrow 150, and the direction that the set of documents 121 may move when the document collection plate 148 has been retracted is shown by the arrow 152. It will be appreciated that any number of documents may be collected on the document collection plate 148 at the time the documents 121 are dropped onto the document platform 108.

In one embodiment, the document collection plate 148 may be located close enough to the document platform 108 so that individual documents in the set of documents 121 properly land on the document platform 108 when the document collection plate 148 is retracted. In an embodiment in which the document strapping system 100 is bundling pre-strapped stacks of documents together, the document collection plate 148 may be located further from the document platform 108 to allow room for the thicker stacks to drop down to the document platform 108. However, it will be appreciated that the distance between the document collection plate 148 and the document platform 108 may vary widely depending on the embodiment or other factors.

An example operation of the document strapping system 100 will now be described with reference to FIGS. 2A through 2D. In FIG. 2A, the document platform 108 is in the receiving position and towards the top of the platform-receiving space 110. In the receiving position, the document platform 108 may receive the document strap 120 so that the document strap 120 is partially or fully over the belt 112. As mentioned above, the document strap 120 may be drawn onto the document platform 108 by rotating the belt 112 around the frame 102.

The set of documents 121 may then be received by the document platform 108 so that the set of documents 121 at least partially cover, either directly or indirectly, the document strap 120 and the belt 112. As described above, the set of documents 121 may be dropped onto the document platform 108 from the document collection plate 148 when a certain number or thickness of documents has been collected.

Moving to FIG. 2B, the document platform 108 may begin its descent into the platform-receiving space 110. As the document platform 108 moves downward closer to the frame base 103, a few things may occur. For example, the upper portions 124 and 125 of the first and second frame arms 104 and 106 may hinge inward towards one another and into the platform-receiving space 110. In one example, the upper portions 124, 125 of the first and second frame arms 104, 106 may be pulled inward by the force exerted by the belt 112 as the document platform 108 moves downward. In yet another example, the upper portions 124 and 125 may be motivated inward using alternative means, such as a motor or spring. The inward motion of the upper portions 124 and 125 may assist in beginning the wrapping of the documents 121 by the belt 112 and the document strap 120 as the document platform 108 moves downward.

It will be appreciated that the document platform 108 may be moved between the receiving position and the lowered position in any manner. In the particular example of FIGS. 1 through 2D, one or more pistons 154, 155 are slidable within the primary post 143 of the document strapping system 100. The document platform 108 may be coupled to these pistons 154, 155 to be moved up and down as desired. The pistons 154, 155 may be motivated in any manner, including by the use of a motor or hydraulically by the use of fluid, including air pressure. Other or alternative means for controlling the movement of the pistons 154, 155 may include hydraulic force, electromechanical force, an electrical-gear drive, springs, magnets, etc.

In FIG. 2C, the document platform 108 has moved into the lowered position between the first and second frame arms 104, 106. In the lowered position, the first and second ends 122, 123 of the document strap 120 have been moved adjacent to one another. Furthermore, the upper portions 124, 125 have moved inward so that they are substantially perpendicular to the lower posts 126, 127, respectively. However, it will be appreciated that the upper portions 124 and 125 may have any, including non-perpendicular, positions relative to the lower posts 126, 127, or any other element, when the document platform 108 is in the lowered position. Furthermore, the first and second top rollers 128, 129, or any other portion of the upper portions 124, 125, may come into indirect contact with a top side 156 of the set of documents 121. In the example of FIG. 2C, the upper portions 124, 125 are on the top side 156 of the set of documents 121, with the document strap 120 and the belt 112 therebetween.

In FIG. 2C, the document strap 120 may fully or partially surround the set of documents 121, and the belt 112 may partially surround the set of documents 121. However, it may be desired to tighten the fit of the document strap 120 around the set of documents 121 to facilitate optimal bundling of the set of documents 121. In one embodiment, this may be achieved by tightening the tension of the belt 112 so that the first and second ends 122, 123 of the document strap 120 are pulled further along the top side 156 of the set of documents 121 so that the document strap 120 tightens around the set of documents 121. Tightening or tensioning of the belt 112 may be achieved by rotating the peripheral roller 119 of the tensioner 117 around the central roller 118 of the tensioner 117 in the direction indicated by the arrow 158. In the particular example of FIG. 2C, the peripheral roller 119 is moved clockwise around the central roller 118; however, it will be appreciated that the orientation and movement of the tensioner 117, and the rollers thereon, may be in any direction. Also, the peripheral roller 119 may be rotated around the central roller 118 at any time during the document strapping process, including during or after the document platform 108 moves into the lowered position. Also, using the fluid pressure-actuated tensioner example, certain levels of pressure may cause different tensions on the belt. For example, by applying higher pressure to the tensioner 117, more tension may be applied to the belt 112, while when less pressure is applied to the tensioner 117, less tension may be applied to the belt 112; however, the opposite case may also be true.

The amount of tension applied to the belt 112 may also be tuned or adjusted based on the particular type of documents in the set of documents 121. For example, less tension may be better suited to worn or highly used documents. The material of the document, the number of documents in the set of documents 121, the shape of the documents, as well as any other factor may also be used to adjust the amount of tension on the belt 112 desired to tighten the document strap 120 around the set of documents 121.

Figure 2D:
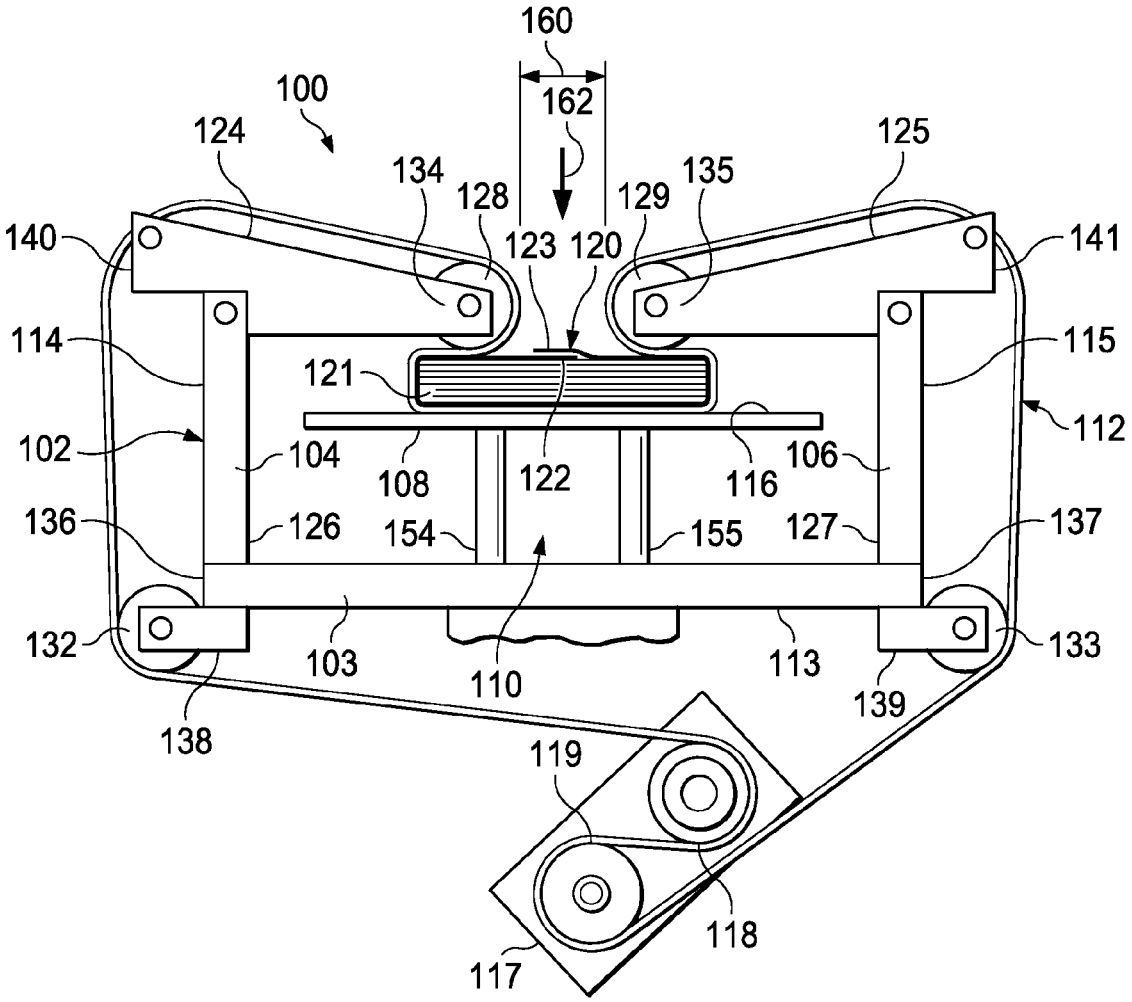
FIG. 2D is a schematic, side view of the document strapping system in FIG. 2C in which the tension of the belt has been increased using a tensioner according to an illustrative embodiment.
Figure 3:
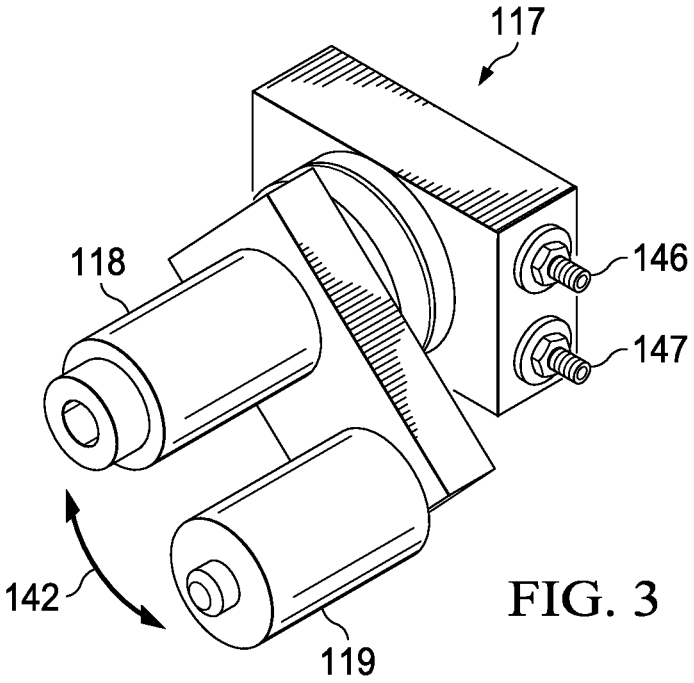
FIG. 3 is a schematic, perspective view of a tensioner according to an illustrative embodiment.

FIG. 2D shows an example of the document strapping system 100 after the tensioner 117 has been rotated to increase the tension on the belt 112 so that the belt 112 is more taut and the document strap 120 more snugly wraps or surrounds the set of documents 121. The upper portions 124 and 125 may form a gap 160 therebetween, thereby exposing one or more adjacent ends 122, 123 of the document strap 120. The gap 160 may be used to facilitate or create a seal between the adjacent ends 122, 123 of the document strap 120. For example, a force may be applied to the adjacent ends 122, 123 of the document strap 120 along the arrow 162. When one or more of the adjacent ends 122, 123 of the document strap 120 are pre-glued or self-adhesive, applying such a force along the arrow 162 may seal the adjacent ends 122, 123, thereby strapping the set of documents 121 together. In another embodiment, a heating element may be applied along the arrow 162 to weld the adjacent ends 122, 123 of the document strap 120. Indeed, the adjacent ends 122, 123 of the document strap 120 may be sealed in numerous ways.

The tightness of the belt 112 varies during the different stages shown in FIGS. 2A through 2D. Also, when the document platform 108 rises back to the receiving position to start another cycle, the belt 112 may loosen as compared to the belt tightness shown in FIG. 2D when the tensioner 117 has been engaged. In one non-limiting example, in FIG. 2C, before the tensioner 117 has been fully engaged, the belt 112 may be half tight, and the belt 112 may be fully tight in FIG. 2D when the tensioner 117 has been engaged. However, these tightnesses may vary depending on the particular embodiment.

The document platform 108 is described above as moving between the various stages shown in FIGS. 2A through 2D. However, in an alternate embodiment, instead of the document platform 108 moving, the document platform 108 may instead remain stationary while the first and second frame arms 104, 106 move. In either case, the frame arms 104, 106 may move relative to the document platform 108 to accomplish the features and functionality described in the illustrative embodiments.

In another embodiment, the document strapping system 100 may be used to strap stacks of documents into a bundle. For example, two or more stacks of documents 121, such as the already-strapped stack of documents shown in FIG. 4, may be positioned on the document platform 108, and a strap may be wrapped and secured around the two or more stacks using the document strapping system 100 as described in the illustrative embodiments. The stacks that are strapped into a larger bundle may already have been strapped using the document strapping system 100, or any other device or method.

In another embodiment, the document strapping system 100 may be used to secure a strap around the set of documents 121 that is perpendicular to the strap secured around the documents shown in FIG. 4. Thus, a strap 120 may be secured around either or both of the length or width of the set of documents 121. In addition, the document strapping system 100 may include a second frame, or another pair of frame arms, that is substantially perpendicular to the frame 102 shown in FIG. 1 so that two straps, perpendicular to one another, may be secured to the set of documents 121. In another embodiment, the position of the set of documents 121 may be rotated by 90 degrees depending on the direction that the strap 120 is to be applied to the set of documents 121.

Figure 5:
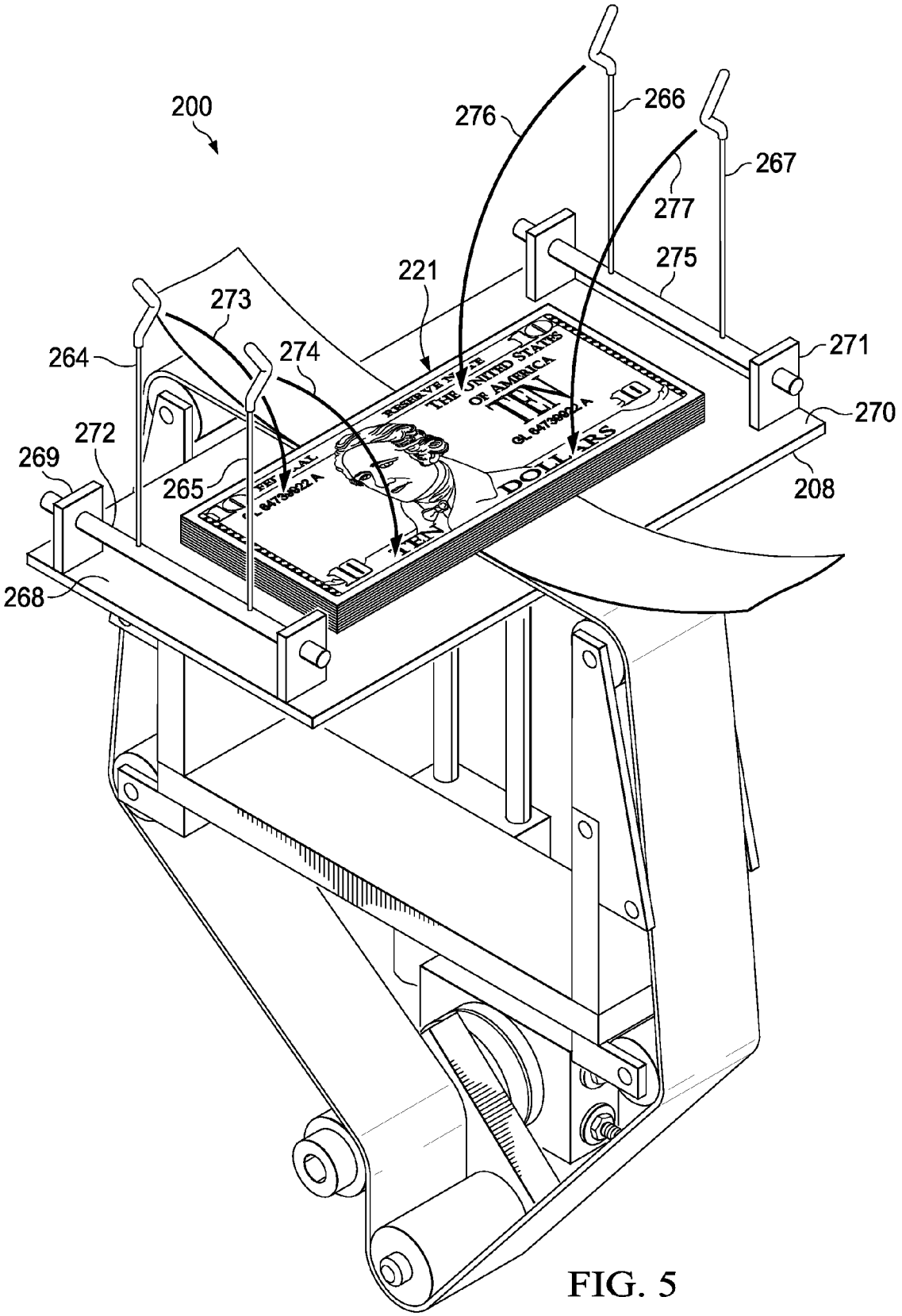
FIG. 5 is a schematic, perspective view of a document strapping system having stabilization arms and document platform edge posts according to an illustrative embodiment.

Referring to FIG. 5, an illustrative embodiment of the document strapping system 200 includes document stabilization arms 264, 265, 266, 267 to hold the set of documents 221 to the document platform 208. Elements of FIG. 5 that are analogous to elements in FIGS. 1-4 have been shown by indexing the reference numerals by 100. The first set of document stabilization arms 264, 265 may be hingeably coupled to a first end 268 of the document platform 208 via a first stabilization arm base 269. Likewise, the second set of document stabilization arms 266, 267 may be hingeably coupled to a second end 270 of the document platform 208 via a second stabilization arm base 271.

A rod 272 within the first stabilization arm base 269 to which the first set of document stabilization arms 264, 265 are coupled, may be rotatable to rotate the document stabilization arms 264, 265 toward the set of documents 221 to contact and hold the set of documents on the document platform 208. The first set of document stabilization rods 264, 265 may be hingeably rotatable to the first end 268 of the document platform 208 to have a back-and-forth range of motion approximating the arrows 273, 274. Likewise, a rod 275 in the second stabilization arm base 271 may be rotatable to move the second set of documents stabilization arms 266, 267 in a range of motion indicated by the arrows 276, 277 so that an opposite end of the set of documents 221 may be held to the document platform 208. The document stabilization arms 264, 265, 266, 267 may also include coated tips, or other types of tips, to facilitate holding down the set of documents 221 while reducing damage or marks to the set of documents 221. In this manner, the document stabilization arms 264, 265, 266, 267 may be used to more securely hold the set of documents 221 against or on the document platform 208 to assist in the strapping of the set of documents 221 as disclosed in the illustrative embodiments. It will be appreciated that the first document stabilization arms 264, 265 may be used without the second document stabilization arms 266, 267.

Figure 6A:
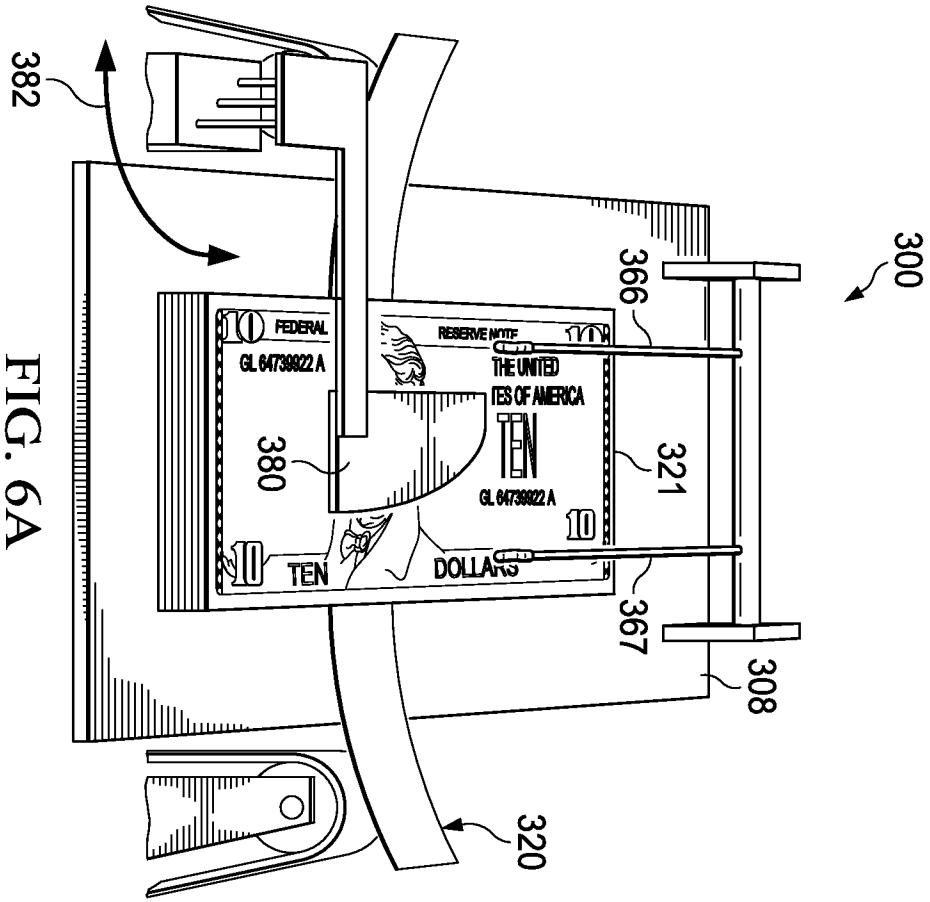
FIG. 6A is a schematic, perspective view of a portion of the document strapping system having a barrier plate engaged on top of the set of documents while the document platform is in the receiving position according to an illustrative embodiment.
Figure 6B:
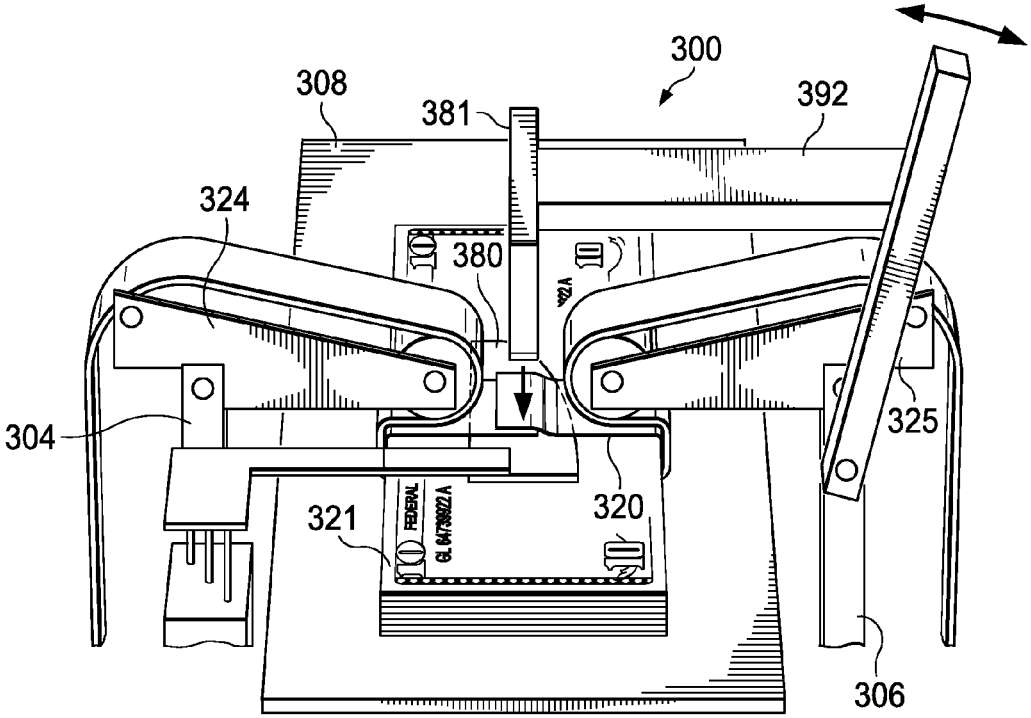
FIG. 6B is a schematic, perspective view of the document strapping system of FIG. 6A in which the document platform is in the lowered position, the barrier plate is disposed between the document strap and a top side of the set of documents, and a heating element is being applied on an exposed section of the document strap according to an illustrative embodiment.

Referring to FIGS. 6A and 6B, an illustrative embodiment of the document strapping system 300 may include a barrier plate 380 that is rotatable, or otherwise movable, between a retracted position and an engaged position to protect the set of documents 321 from a heating element 381 used to weld adjacent ends of the document strap 322 to one another. Elements of FIGS. 6A and 6B that are analogous to elements in FIGS. 1-4 have been shown by indexing the reference numerals by 200. The barrier plate 380 is shown to be in the engaged position in FIGS. 6A and 6B. FIG. 6A shows the document platform 308 in the receiving position, and FIG. 6B shows the document platform 308 in the lowered position after the document strap 320 has been wrapped around the set of documents 321. The barrier plate 380 may be considered to be in the engaged position when the barrier plate 380 is over or on top of the set of documents 321. The barrier plate 380 may be retracted away from the set of documents 321 along the arrow 382 to move into the retracted position.

The document strapping system 300 also includes the document stabilization arms 366, 367 engaged against the set of documents 321 to stabilize the set of documents 321 during the processes performed by the document strapping system 300. As described above, the document stabilization arms 366, 367 may be retracted or engaged. For example, the document stabilization arms 366, 367 may clamp the set of documents 321 before the barrier plate 380 is engaged on the set of documents 321. It will be appreciated that, although only two document stabilization arms 366, 367 are shown in FIG. 6A, additional document stabilization arms may be present on the opposite end of the document platform 308, or anywhere else on the document platform 308.

When the barrier plate 380 is in the engaged position and the document platform 308 moves from the receiving position to the lowered position, as described above, the barrier plate 380 may move with the document platform 308 to remain close to or touching the top side of the set of documents 321. When the document strapping system 300 surrounds the set of documents 321 as described above, the document strap 320 may surround both the set of documents 321 and the barrier plate 380, as shown in FIG. 6B. In particular, the barrier plate 380 is shown to be disposed between the document strap 320 and a top side of the set of documents 321. The heating element 381 may then come into contact with the ends of the document strap 320 to weld the ends of the document strap 320 together through the gap formed by the upper portions 324, 325 of the first and second arm frames 304, 306. The barrier plate 380 may protect the set of documents 321 from being damaged when the heating element 381 is applied to the document strap 320. After the document strap 320 has been sealed, the barrier plate 380 may be rotatable or movable to retract away from the set of documents 321 so that the bundled set of documents 321 may undergo further processing.

The heating element 381 may be secured or held by a bracket 392 that is coupled to one of the frame arms 304, 306 or any other structure. The bracket 392 may be hingeably coupled to a portion of the second frame arm 306 so that application of the heating element 381 may be controlled by rotating or moving the bracket 392. For example, in FIG. 6B the bracket may be hinged or moved toward the set of documents 321 so that the heating element 381 moves toward the document strap 320 to seal the document strap 320. It will be appreciated that the heating element 381 may be applied to the document strap 320 in any manner, including by hand or by any other structure or mechanism.

Figure 7:
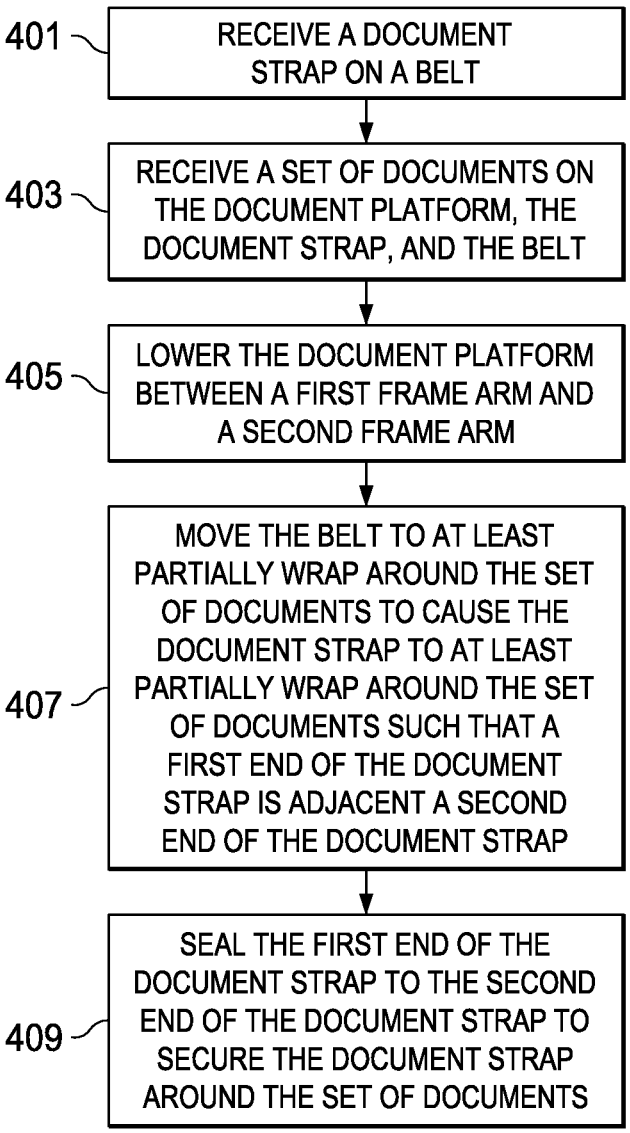
FIG. 7 is a flowchart of a process for strapping a set of documents according to an illustrative embodiment.

Referring to FIG. 7, an illustrative embodiment of a process for strapping a set of documents includes receiving a document strap on a belt (step 401). The process also includes receiving a set of documents on the document platform, the document strap, and the belt (step 403).

The process also includes lowering the document platform between a first frame arm and a second frame arm (step 405). The process includes moving the belt to at least partially wrap around the set of documents to cause the document strap to at least partially wrap around set of documents such that a first end of the document strap is adjacent a second end of the document strap (step 407). The process also includes sealing the first end of the document strap to the second end of the document strap to secure the document strap around the set of documents (step 409).

In an alternative embodiment, instead of moving the document platform, as described above, the frame may be moved towards the document platform such that the document platform sits between the frame arms. The frame may then return to its original position after the set of documents is strapped. In another alternative embodiment, the set of documents may be dropped to a document platform already between the frame arms such that no relative movement between the frame and document platform is required.

The flowcharts and block diagrams in the different depicted embodiments illustrate the architecture, functionality, and operation of some possible implementations of apparatus, methods and computer program products. In this regard, each block in the flowchart or block diagrams may represent a module, segment, or portion of code, which comprises one or more executable instructions for implementing the specified function or functions. In some alternative implementations, the function or functions noted in the block may occur out of the order noted in the Figures. For example, in some cases, two blocks shown in succession may be executed substantially concurrently, or the blocks may sometimes be executed in the reverse order, depending upon the functionality involved.

Figure 8A:
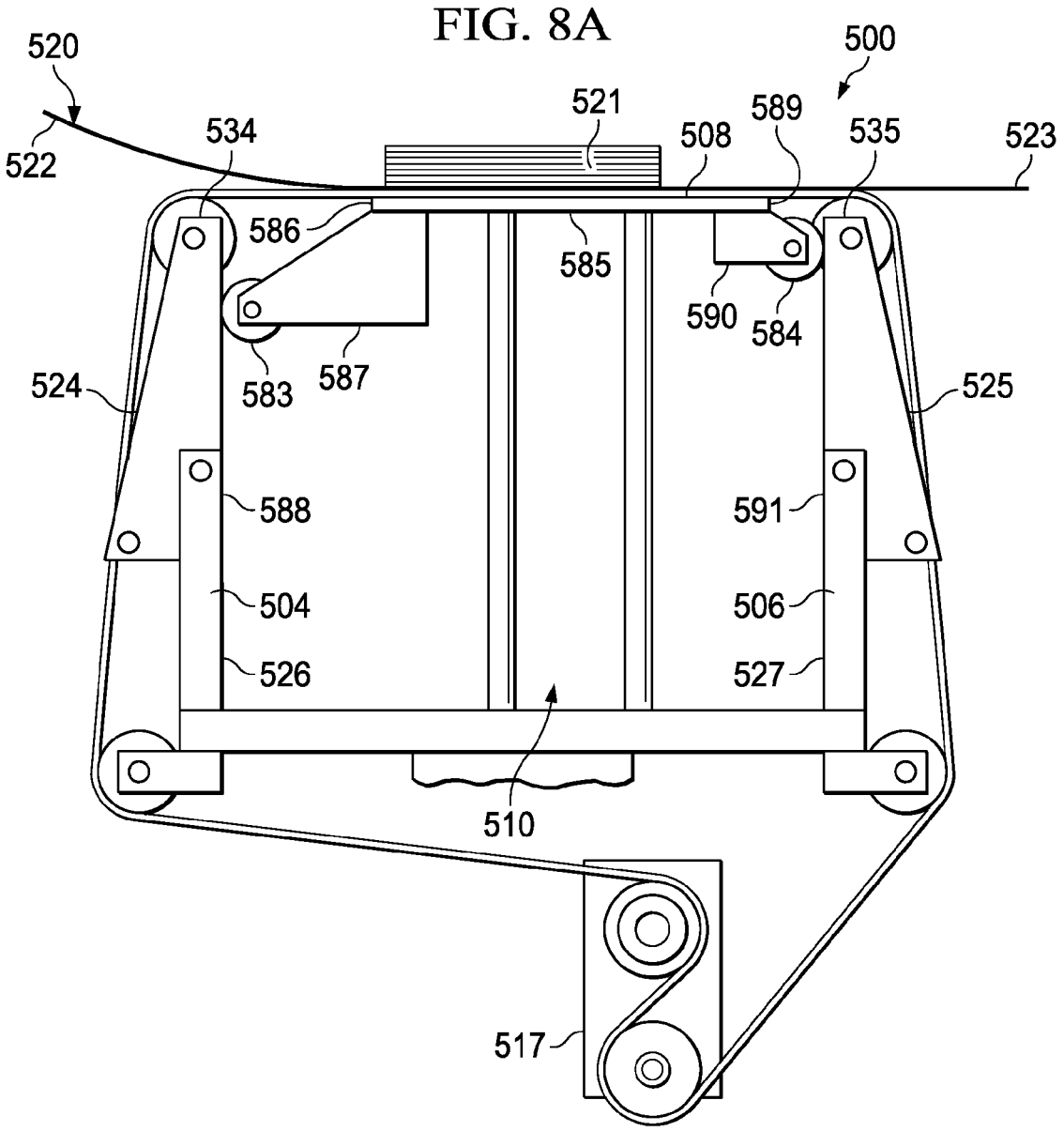
FIG. 8A is a schematic, side view of a document strapping system having a document platform and timing rollers in the receiving position according to an illustrative embodiment.
Figure 8B:
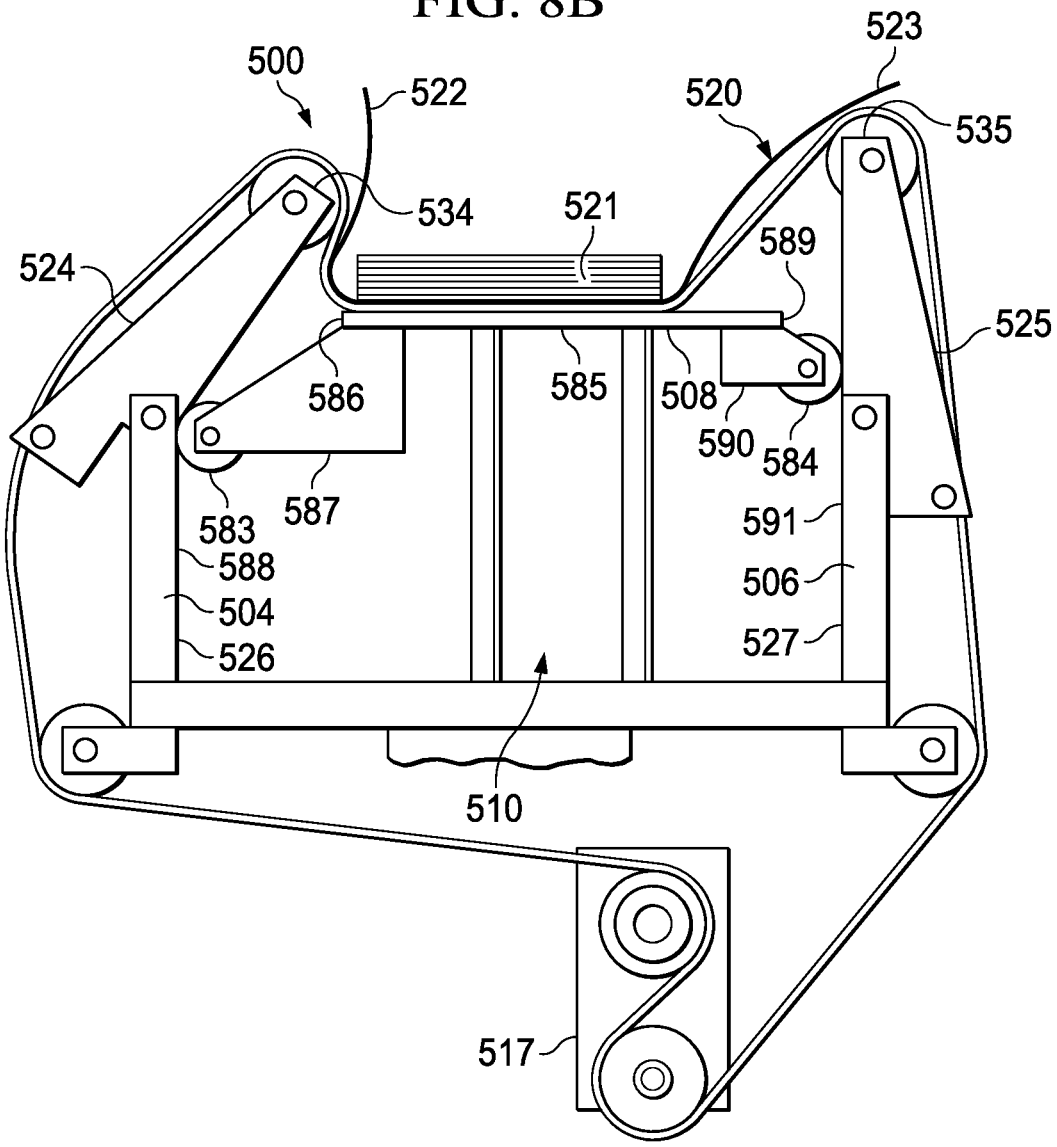
FIG. 8B is a schematic, side view of the document strapping system in FIG. 8A with the document platform and timing rollers descending between the first and second frame arms according to an illustrative embodiment.
Figure 8C:
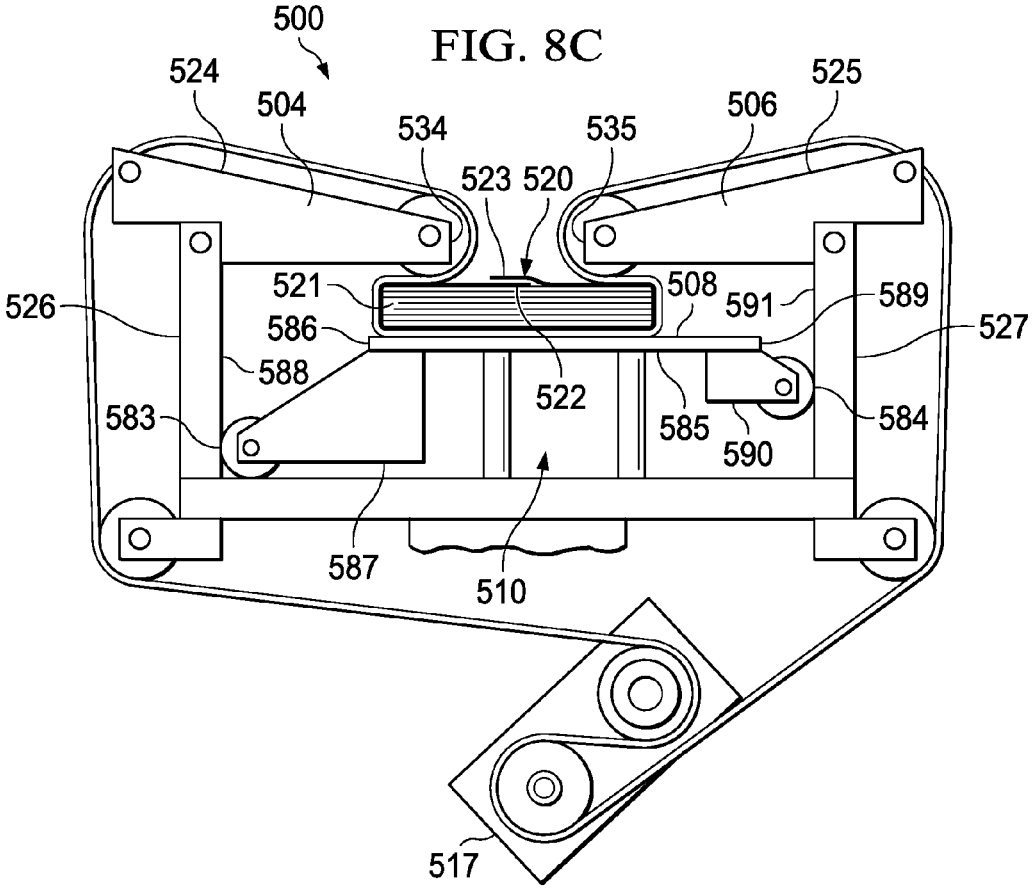
FIG. 8C is a schematic, side view of the document strapping system in FIG. 8B showing the document platform and timing rollers in the lowered position according to an illustrative embodiment.

Referring to FIGS. 8A through 8C, an illustrative embodiment of the document strapping system 500 is shown that includes a first timing roller 583 and a second timing roller 584 coupled to a bottom side 585 of the document platform 508. In this embodiment, the first and second timing rollers 583, 584 are used to allow the upper portions 524, 525 of the first and second frame arms 504, 506, respectively, into the platform-receiving space 510 at different times as the document platform 508 moves from the receiving position, shown in FIG. 8A, to the lowered position, shown in FIG. 8C.

In one embodiment, the first timing roller 583 is rotatably coupled to the bottom side 585 of the document platform 508 adjacent a first edge 586 of the document platform 508. The first timing roller 583 may be coupled to the bottom side 585 of the document platform 508 by a bracket 587 or in any other manner. The first timing roller 583 may at least partially contact the first frame arm 504. In particular, the first timing roller 583 may be adapted to roll along an inner-facing side 588 of the first frame arm 504.

Likewise, the second timing roller 584 may be rotatably coupled to the bottom side 585 of the document platform 508 adjacent a second edge 589 of the document platform 508. The second timing roller 584 may be coupled to the bottom side 585 of the document platform 508 by a bracket 590 or in any other manner. The second timing roller 584 may at least partially contact the second frame arm 506. In particular, the second timing roller 584 may be adapted to roll along an inner-facing side 591 of the second frame arm 506.

The first timing roller 583 may be positioned farther from the bottom side 585 of the document platform 508 than the second timing roller 584. In other words, the distance between the first timing roller 583 and the document platform 508 may be greater than the distance between the second timing roller 584 and the document platform 508. The differing positions of the first and second timing rollers 583, 584 may be utilized to cause the upper portions 524, 525 to move into the platform-receiving space 510 at different times as the document platform 508 moves from the receiving position into the lowered position.

In one embodiment, the set of documents 521 may be positioned adjacent the first edge 586 of the document platform 508, as shown in FIGS. 8A through 8C. In this embodiment, the distance between the first frame arm 504 and the first edge 586 of the document platform 508 may be greater than the distance between the second frame arm 506 and the second edge 589 of the document platform 508 such that, when the set of documents 521 is located adjacent the first edge 586 of the document platform 508, the set of documents 511 is still approximately or substantially midway, or centered, between the first and second frame arms 504, 506. Such positioning of the set of documents 521 and the document platform 508 may be used in any of the illustrative embodiments described herein.

As shown in FIG. 8A, the document platform 508 is in the receiving position. In this position, the first timing roller 583 at least partially contacts the upper portion 524 of the first frame arm 504 and the second timing roller 584 at least partially contacts the upper portion 525 of the second frame arm 506. At this stage, the second timing roller 584 is closer to the top end 535 of the second frame arm 506 than the first timing roller 583 is to the top end 534 of the first frame arm 504.

With reference to FIG. 8B, the document platform 508 has moved into the platform-receiving space 510 and is in transition between the receiving position and the lowered position. The first timing roller 583 has moved past the hingeable coupling between the upper portion 524 and the lower post 526 of the first frame arm 504, and therefore no longer holds the upper portion 524 in the upright position. Hence, the upper portion 524 of the first frame arm 504 has begun moving into the platform-receiving space 510 and toward the inward-pointing position. For a period of time after the upper portion 524 of the first frame arm 504 has begun moving into the platform-receiving space 510, the upper portion 525 of the second frame arm 506 remains in the upright position. In particular, because the second timing roller 584 is closer to the document platform 508 than the first timing roller 583, in FIG. 8B the second timing roller 584 continues to hold the upper portion 525 of the second frame arm 506 in the upright position after the first timing roller 583 has already ceased to support the upper portion 524 of the first frame arm 504 in the upright position. In FIG. 8B, the second timing roller 584 has not yet moved past the hingeable coupling between the upper portion 525 and the lower post 527 of the second frame arm 506, causing the upper portions 524, 525 of the first and second frame arms 504, 506, respectively, to move into the platform-receiving space 510 at different times. By allowing the upper portions 524, 525 of the first and second frame arms 504, 506, respectively, to move into the platform-receiving space 510 at different times, the strap ends 522, 523 may be prevented from interfering with one another when folded over; also, a desirable overlap may be provided when the strap ends 522, 523 are welded or adhered to one another.

Referring to FIG. 8C, the document platform 508 is shown in the lowered position such that the set of documents 521 have been wrapped by the document strap 520. At this stage, both the first timing roller 583 and the second timing roller 584 have moved past the hingeable couplings between the upper portions 524, 525 and the lower posts 526, 527 of the first and second frame arms 504, 506, respectively, so that the upper portions 524, 525 are both allowed to move into the inward-pointing positions. The tensioner 517 has also been tightened to provide a snug fit for the document strap 520 around the set of documents 521.

In one illustrative embodiment, the first and second frame arms 504 and 506 may include springs (not shown) that bias the upper portions 524, 525 toward the inward-pointing positions shown in FIG. 8C. In this embodiment, the first and second timing rollers 583, 584 provide a resistive force against the upper portions 524, 525 moving into the inward-pointing positions while the first and second timing rollers 583, 584 are in contact with the upper portions 524, 525. However, when the first and second timing rollers 583, 584 are no longer in contact with either or both of the upper portions 524, 525, as shown in FIGS. 8B and 8C, the spring may bias either or both of the upper portions 524, 525 into the platform-receiving space 510. In one embodiment, the springs may be located at the hingeable couplings between the upper portions 524, 525 and the lower posts 526, 527 of the first and second frame arms 504, 506, respectively.

As used herein, including in the claims, the terms first, second, third, etc. . . . used in relation to an element (e.g., first frame arm, second frame arm, etc.) are for reference or identification purposes only, and these terms, unless otherwise indicated, are not intended to describe or suggest a number, order, source, purpose, or substantive quality for any element for which such a term is used.

Although the illustrative embodiments described herein have been disclosed in the context of certain illustrative, non-limiting embodiments, it should be understood that various changes, substitutions, permutations, and alterations can be made without departing from the scope of the invention as defined by the appended claims. It will be appreciated that any feature that is described in a connection to any one embodiment may also be applicable to any other embodiment.

What is claimed is:

1. An apparatus for strapping a set of documents, the apparatus comprising:

a document platform to receive a set of documents and a document strap while the document platform is in a receiving position, the document strap positionable between the document platform and the set of documents;

a frame having a first frame arm and a second frame arm forming a platform-receiving space between the first and second frame arms, each of the first and second frame arms comprises a moveable portion pivotably coupled to another portion of the frame; and a belt disposed between the document platform and the document strap when the document platform receives the set of documents;

wherein when the document platform moves from the receiving position into the platform-receiving space, the moveable portion of the first frame arm and the moveable portion of the second frame arm move into the platform-receiving space to cause the belt and the document strap to at least partially surround the set of documents, thereby strapping the set of documents together.

2. The apparatus of claim 1, wherein the document strap has a first end and a second end; and wherein the first end of the document strap is sealable to the second end of the document strap to secure the document strap around the set of documents when the document strap at least partially surrounds the set of documents.

3. The apparatus of claim 1, wherein the moveable portion of the first frame arm is an upper, moveable portion hingeably coupled to the other portion of the frame;

wherein the moveable portion of the second frame arm is an upper, moveable portion hingeably coupled to the other portion of the frame;

wherein when the document platform moves from the receiving position into the platform-receiving space, the upper portion of the first frame arm and the upper portion of the second frame arm move toward one another and into the platform-receiving space to cause the belt and the document strap to at least partially surround the set of documents, thereby strapping the set of documents together.

4. The apparatus of claim 3, wherein, when the upper portion of the first frame arm and the upper portion of the second frame arm move toward one another and into the platform-receiving space to cause the belt and the document strap to at least partially surround the set of documents, the upper portions of the first and second frame arms are positioned on a top side of the set of documents; and wherein, when the upper portions of the first and second frame arms are positioned on the top side of the set of documents, the upper portion of the first frame arm and the upper portion of the second frame arm are spaced apart to form a gap at least partially exposing adjacent ends of the document strap.

5. The apparatus of claim 3, wherein, when the document platform is in the receiving position, the upper portion of the first frame arm and the upper portion of the second frame arm are in a substantially upright position; and wherein, when the document platform is moved into the platform-receiving space, the upper portion of the first frame arm and the upper portion of the second frame arm are in an inward-pointing position.

6. The apparatus of claim 5, wherein the first frame arm further comprises a lower post, the upper portion of the first frame arm hingeably coupled to the lower post of the first frame arm;

wherein the second frame arm further comprises a lower post, the upper portion of the second frame arm hingeably coupled to the lower post of the second frame arm;

wherein the upper portion of the first frame arm is substantially parallel to the lower post of the first frame arm when the upper portion of the first frame arm is in the upright position;

wherein the upper portion of the second frame arm is substantially parallel to the lower post of the second frame arm when the upper portion of the second frame arm is in the upright position;

wherein the upper portion of the first frame arm is substantially perpendicular to the lower post of the first frame arm when the upper portion of the first frame arm is in the inward-pointing position; and wherein the upper portion of the second frame arm is substantially perpendicular to the lower post of the second frame arm when the upper portion of the second frame arm is in the inward-pointing position.

7. The apparatus of claim 6, further comprising:

a first timing roller rotatably coupled to a bottom side of the document platform adjacent a first edge of the document platform, the first timing roller at least partially contacting the first frame arm;

a second timing roller rotatably coupled to a bottom side of the document platform adjacent a second edge of the document platform, the second timing roller at least partially contacting the second frame arm;

wherein the first timing roller is positioned further away from the document platform than the second timing roller; and wherein, as the document platform and the first and second timing rollers move from the receiving position into the platform-receiving space, the second timing roller holds the upper portion of the second frame arm in the upright position longer than the first timing roller holds the upper portion of the first frame arm in the upright position such that the upper portion of the first frame arm moves into the platform-receiving space before the upper portion of the second frame arm moves into the platform-receiving space.

8. The apparatus of claim 7, wherein, as the document platform and the first and second timing rollers move from the receiving position into the platform-receiving space, the upper portion of the first frame arm begins moving toward the inward-pointing position approximately when the first timing roller moves past the hingeable coupling between the upper portion of the first frame arm and the lower post of the first frame arm and the upper portion of the second frame arm begins moving toward the inward-pointing position approximately when the second timing roller moves past the hingeable coupling between the upper portion of the second frame arm and the lower post of the second frame arm, the first timing roller moving past the hingeable coupling between the upper portion of the first frame arm and the lower post of the first frame arm before the second timing roller moves past the hingeable coupling between the upper portion of the second frame arm and the lower post of the second frame arm.

9. The apparatus of claim 1, wherein the frame further comprises a frame base, each of the first frame arm and the second frame arm substantially perpendicular to the frame base when the document platform is in the receiving position; and wherein the belt at least partially surrounds the frame adjacent at least outer-facing sides of the frame base, the first frame arm, and the second frame arm.

10. The apparatus of claim 9, further comprising:

a set of rollers coupled to the frame and adapted to contact the belt to facilitate movement of the belt around the frame.

11. The apparatus of claim 10, wherein the set of rollers comprises:

first and second top rollers, the first top roller adjacent a top end of the first frame arm, the second top roller adjacent a top end of the second frame arm; and first and second bottom rollers, the first bottom roller adjacent a first end of the frame base, the second bottom roller adjacent a second end of the frame base.

12. The apparatus of claim 1, wherein the first frame arm comprises the movable portion and a lower post, the movable portion of the first frame arm hingeably coupled to the lower post of the first frame arm; and wherein the second frame arm comprises the movable portion and a lower post, the movable portion of the second frame arm hingeably coupled to the lower post of the second frame arm.

13. The apparatus of claim 9, further comprising:

a tensioner located adjacent the frame, the tensioner having a central roller and a peripheral roller, the belt passing between the central roller and the peripheral roller;

wherein the peripheral roller is rotatable around the central roller to increase a tension of the belt around the frame.

14. The apparatus of claim 13, wherein, during or after the document platform moves into the platform-receiving space to cause the belt and the document strap to at least partially surround the set of documents, the peripheral roller is rotatable around the central roller to increase the tension of the belt such that the strap is tightened around the set of documents.

15. The apparatus of claim 13, wherein the central roller is rotatable using a motor to motivate the belt to move around the frame.

16. The apparatus of claim 15, wherein the belt is moveable around the frame to draw the document strap onto the document platform prior to the set of documents being placed on the document platform.

17. The apparatus of claim 1, further comprising:

a first set of document stabilization arms hingeably coupled to a first end of the document platform; and a second set of document stabilization arms hingeably coupled to a second end of the document platform;

wherein the first and second set of document stabilization arms are rotatable toward the set of documents to contact and hold the set of documents on the document platform.

18. The apparatus of claim 1, further comprising:

a barrier plate rotatable between a retracted position and an engaged position, the barrier plate positioned on top of the set of documents when in the engaged position;

wherein, when the document platform moves into the platform-receiving space to cause the belt and the document strap to at least partially surround the set of documents, the barrier plate moves with the document platform to remain on top of the set of documents;

wherein the document strap at least partially surrounds the set of documents and the barrier plate when the document platform moves into platform-receiving space such that the barrier plate is disposed between the document strap and a top side of the set of documents;

wherein the document strap has a first end and a second end;

wherein the apparatus further comprises a heating element to weld the first end of the document strap to the second end of the document strap to secure the strap around the set of documents; and wherein the barrier plate protects the heating element from damaging the set of documents when the heating element welds the first end of the document strap to the second end of the document strap.

19. The apparatus of claim 18, wherein the barrier plate is rotatable from the engaged position to the retracted position away from the set of documents after the first end of the document strap is welded to the second end of the document strap.

20. The apparatus of claim 1, further comprising:

a document collection plate positionable above the document platform to collect the set of documents, the document collection plate retractable to drop the set of documents onto the document platform while the document platform is in the receiving position.

* * * * *